United States Patent [19]

Panagin

[11] 4,353,313

[45] Oct. 12, 1982

[54] BODY FOR A RAILWAY CARRIAGE

[75] Inventor: Romano Panagin, Turin, Italy

[73] Assignee: Centro Ricerche Fiat S.p.A., Turin, Italy

[21] Appl. No.: 143,686

[22] Filed: Apr. 25, 1980

[30] Foreign Application Priority Data

May 24, 1979 [IT] Italy ..... 68111 A/79

[51] Int. Cl.[3] ..... B61D 17/00

[52] U.S. Cl. ..... 105/397; 105/401; 280/785; 296/178

[58] Field of Search ..... 105/396, 397, 399, 401–403, 105/413, 414; 296/175, 178, 196, 197; 280/785; 244/119, 120; 52/67, 632; 403/393; 29/428

[56] References Cited

U.S. PATENT DOCUMENTS

| | | | |
|---|---|---|---|
| 654,926 | 7/1900 | State | 105/414 X |
| 2,281,245 | 4/1942 | Parke et al. | 105/414 |
| 2,697,990 | 12/1954 | Parsons et al. | 105/397 |
| 2,842,972 | 7/1958 | Houdart | 296/175 X |
| 2,925,050 | 2/1960 | Candlin, Jr. et al. | 105/397 |
| 2,946,297 | 7/1960 | Dean et al. | 105/397 |
| 3,100,458 | 8/1963 | Baker et al. | 105/397 |
| 4,231,144 | 11/1980 | Bernacchia, Jr. | 29/428 X |
| 4,235,170 | 11/1980 | Bauer | 105/402 |

FOREIGN PATENT DOCUMENTS

| | | | |
|---|---|---|---|
| 608280 | 1/1935 | Fed. Rep. of Germany | 105/397 |
| 924980 | 4/1947 | France | 105/397 |
| 963042 | 7/1964 | United Kingdom | 280/785 |

*Primary Examiner*—Randolph A. Reese

*Attorney, Agent, or Firm*—Sughrue, Mion, Zinn, Macpeak & Seas

[57] ABSTRACT

A railway carriage body comprises a shell structure formed from a base sub-assembly, a pair of side-and-roof sub-assemblies each of which constitute one side and part of the roof of the body, and a pair of end-wall units. The base and side-and-roof sub-assemblies when assembled together make up a series of transverse rectangular frames interconnected by longitudinal girders to which a sheet metal covering is fixed. Each frame includes a two-part lower transverse element forming part of the base sub-assembly, and a two-part upper transverse frame element the two component parts of which are included in respective ones of the side-and-roof sub-assemblies. The two frame parts making up each upper and lower transverse frame element are so fashioned as to permit them to be adjusted longitudinally of each other during assembly and prior to being rigidly connected together; as a result, the width of the carriage body can be set as required.

1 Claim, 9 Drawing Figures

BODY FOR A RAILWAY CARRIAGE

The present invention relates to a body for railway carriages.

The object of the invention is to provide a railway carriage body which is of simple construction and of considerably less weight than known carriage bodies.

With a view to achieving this object, the present invention provides a railway carriage body in the form of a shell structure comprising:

a base sub-assembly comprising a series of transverse lower frame elements spaced longitudinally of the body and each constituted by a respective pair of sheet-metal frame parts welded together, girders inter-connecting the lower frame elements, an outer sheet-metal covering fixed to the girders and to the lateral and lower edges of the lower frame elements, and a flooring fixed to the upper edges of the said lower frame elements, a pair of side-and-roof sub-assemblies each forming one side and part of the roof of the body and comprising a series of vertically-extending lateral frame elements connected at their lower ends to the outer ends of the said lower frame elements, and a series of upper transverse frame parts connected to the upper ends of the respective ones of the vertical frame elements, corresponding frame parts of the two side-and-roof sub-assemblies being welded together in the assembled body to form a series of transverse frame elements which together with the lateral and lower frame elements form a series of frames of rectangular shape, each side-and-roof sub-assembly further comprising a plurality of girders extending longitudinally of the body and serving to inter-connect the frame elements of the sub-assembly, and an outer sheet-metal covering affixed to the frame elements and girders and provided with window and door openings surrounded by strengthening frames, and a pair of end-wall units affixed to opposite ends of the said sub-assemblies, the frame parts making up each upper and each lower frame element having their inner end portions, considered laterally of the body, so fashioned as to allow the length of the corresponding frame element to be adjusted prior to welding together of the frame parts during assembly whereby to enable the width of the body to be set as required.

The carriage body can be seen to consist of prefabricated modular elements which can be assembled together in a simple and economic manner.

A carriage body embodying the invention will now be particularly described, by way of example, with reference to the accompanying diagrammatic drawings, in which.

Figure 1:
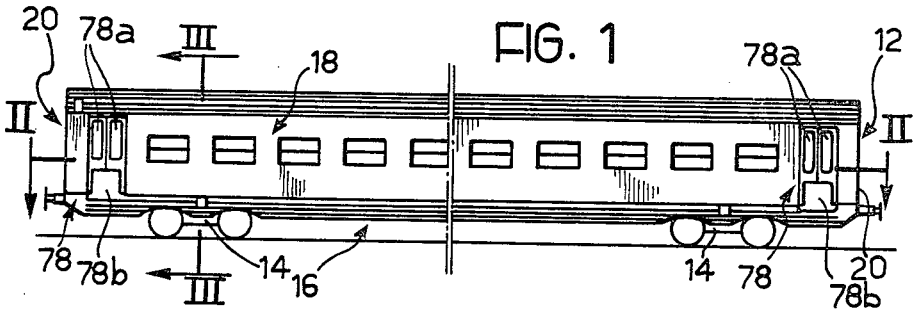
FIG. 1 is a side elevation of a railway carriage incorporating the body.
Figure 2:
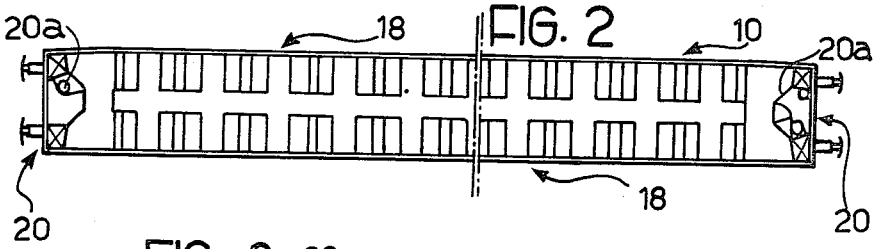
FIG. 2 is a section on line II—II of FIG. 1.
Figure 3:
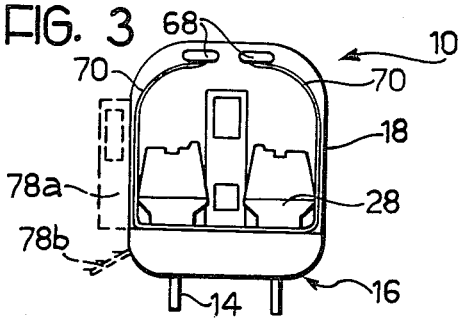
FIG. 3 is a section on line III—III of FIG. 1.
Figure 4:
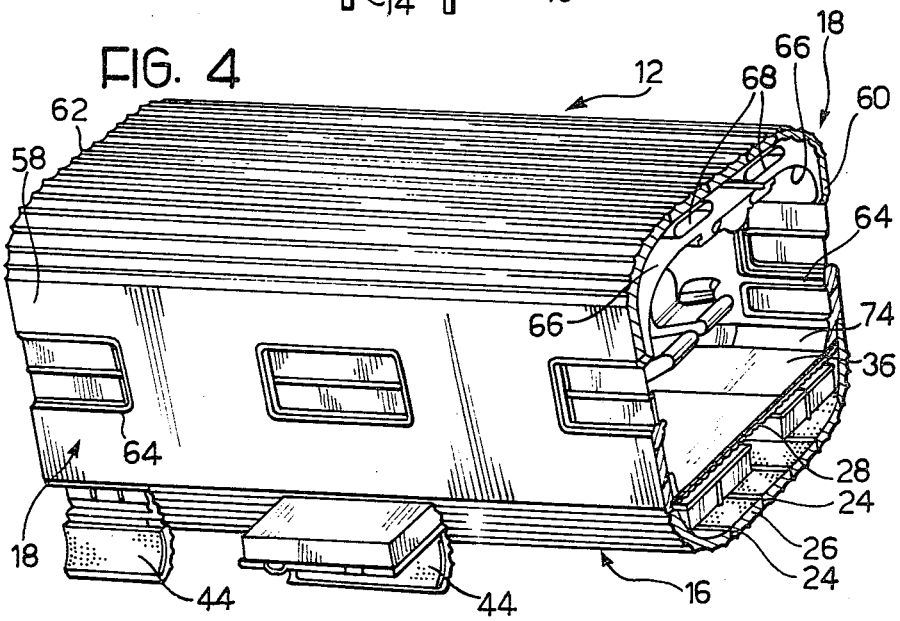
FIG. 4 shows, to an enlarged scale, a part-cutaway, perspective view of a portion of the carriage body illustrated in FIGS. 1 to 3.
Figure 5:
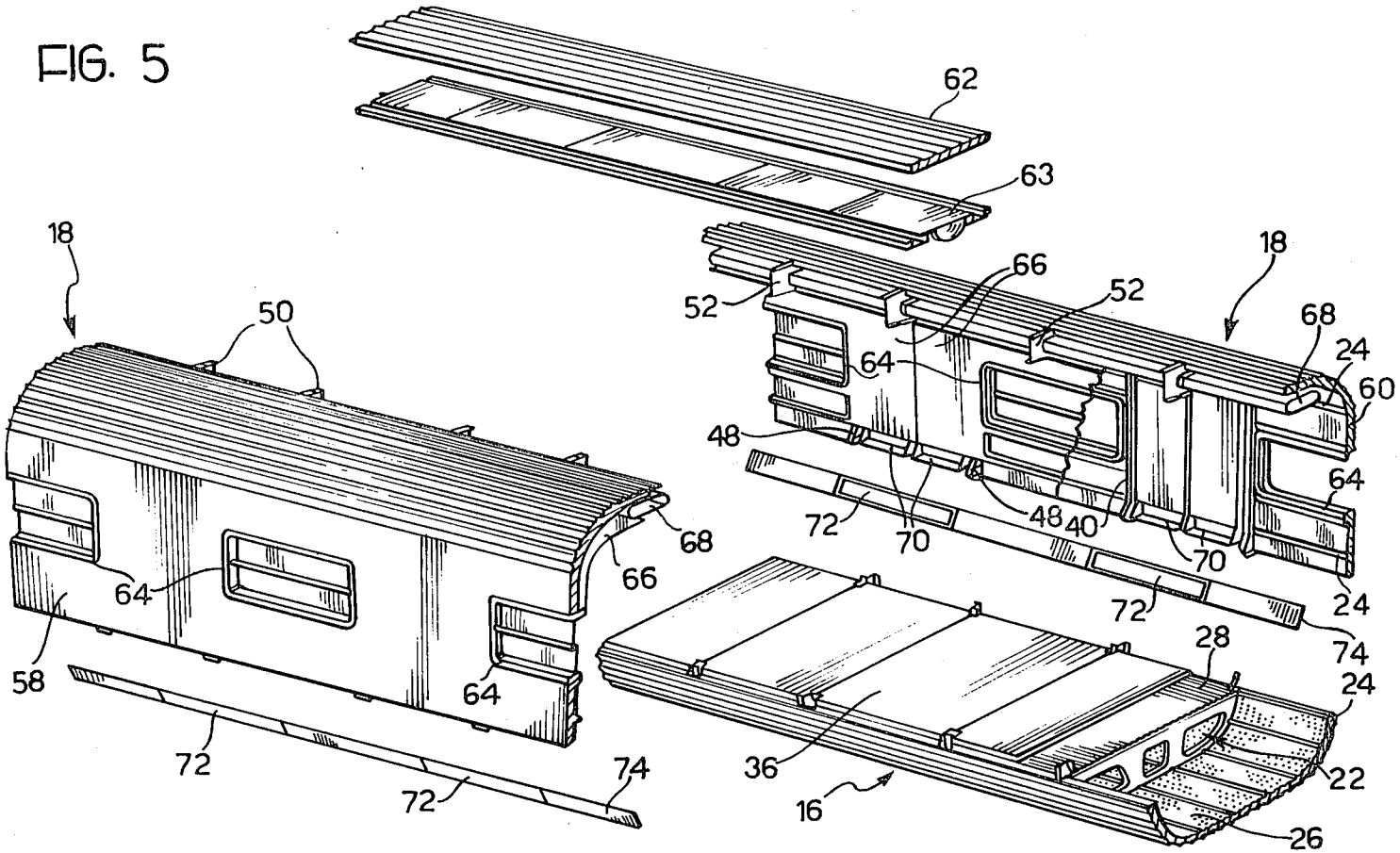
FIG. 5 is an exploded perspective view of the body portion shown in FIG. 4.

As shown in FIGS. 1 to 3, the railway carriage comprises a body 12, and two bogies or trucks 14 supporting the body 12 adjacent its ends. Although in the example illustrated the bogies only have a load-bearing function; the following description of the carriage body 12 is equally applicable to the case in which the carriage 10 is provided with driving bogies.

The body 12 is composed of five structural sub-assemblies, separately pre-fabricated and assembled together to form a shell structure, these five sub-assemblies being a longitudinal base sub-assembly 16, two longitudinal side-and-roof sub-assemblies 18 each constituting one side and half of the roof of the body 12, and two end-wall units 20.

Referring to FIGS. 4 to 7, the base sub-assembly comprises a series of lower transverse frame elements 22 spaced apart longitudinally of the body 12 and interconnected by channel-shaped girders 24, an outer covering 26 of sheet metal shaped as a trough, and a horizontal flooring 28.

Figure 7:
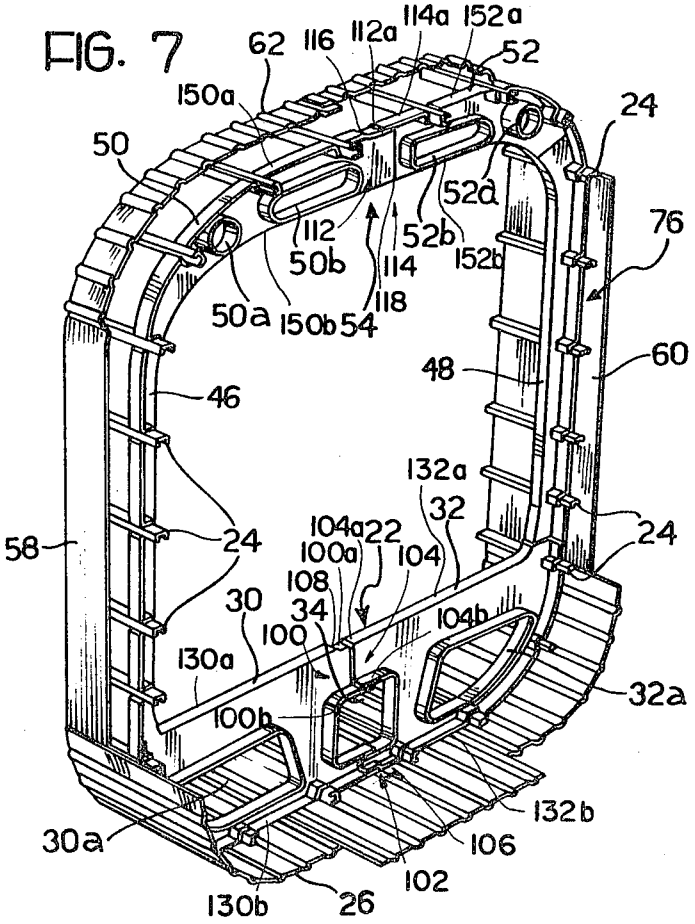
FIG. 7 is a perspective view illustrating the transverse frame of FIG. 6 in its assembled state.
Figure 6:
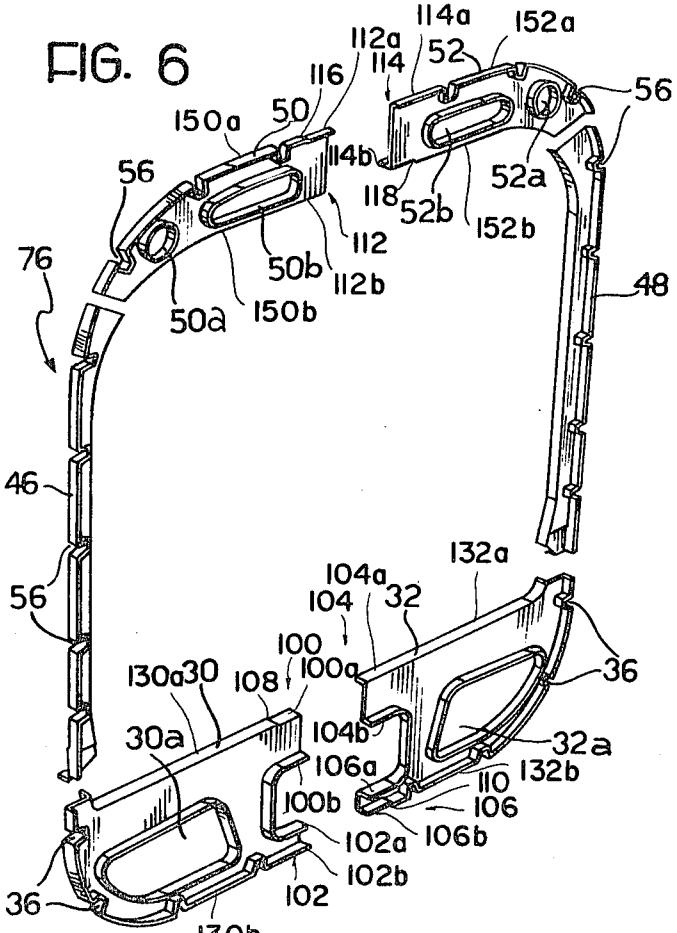
FIG. 6 is an exploded perspective view, to an enlarged scale, of a transverse frame of the carriage body.

As shown in detail in FIGS. 6 and 7, each lower frame element 22 is formed in two halves, each half being constituted by a sheet-metal frame part 30, 32 formed with openings 30*a*, 32*a*. Each frame part 30, 32 is curved along one edge in conformity with the desired shape of the covering 26. The juxtaposed ends of each pair of frame parts 30,32 are so fashioned as to fit together to form a telescoped coupling between these parts which allows them to be slid longitudinally of each other during assembly so that the width of the frame element 22 can be adjusted as required.

Referring to FIG. 6, two spaced-apart lugs 100,102 protrude longitudinally from the inner end portion of the lower frame part 30, and two corresponding spaced-apart lugs 104,106 project longitudinally from the inner end portion of the lower frame part 32.

Lugs 100 and 104 are substantially Z-shaped with upper and lower horizontally-extending flanges 100*a*,100*b* and 104*a*,104*b*, respectively, while lugs 102,106 are U-shaped with respective upper and lower horizontally-extending flanges 102*a*,102*b* and 106*a*,106*b*.

The upper flange 100*a* of lug 100 is depressed at 108 and offset with respect to the upper flange 104*a* of lug 104, while the lower flange 100*b* is offset with respect to the lower flange 104*b*. The lower flange 106*b* of lug 106 is raised at 110 and offset with respect to the lower flange 102*b* of lug 102, and the upper flange 106*a* is offset with respect to the upper flange 102*a*.

In the assembled condition of the two lower frame parts 30, 32, shown in FIG. 7, lug 106 is telescoped within the cavity of lug 102 and lugs 100,104 are telescoped one within the other. The upper flanges 130*a*, 132*a* of the frame parts 30 and 32, respectively are disposed at the same level, as are the lower flanges 130*b*,132*b* thereof.

The two frame parts 30, 32 making up each frame element 22 are welded to each other and together define a further, central, opening 34. The side and bottom edges of each frame element 22 are flanged and formed with a number of square notches 36 which serve to seat the girders 24, these girders being spot welded in position. The upper edges of the frame elements 22 are formed with horizontal flanges which serve to support the flooring 28.

The flooring 28 comprises corrugated metal sheets welded to the frame elements 22 and serving to enhance the strength of the base sub-assembly 16. On top of the corrugated sheets are placed panels 36 of resin compensate completing the flooring 28.

Figure 8:
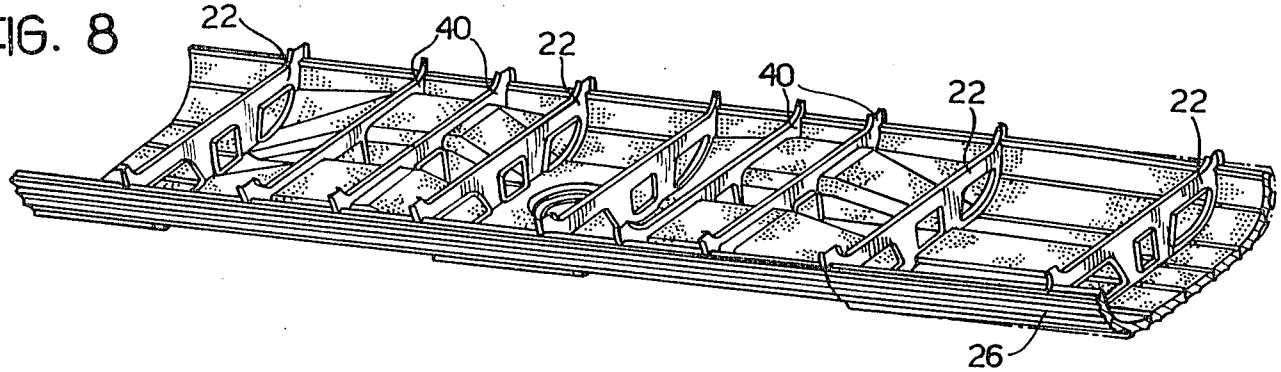
FIG. 8 is a perspective view of part of a base sub-assembly of the body in the region of one of the bogies of the carriage.
Figure 9:
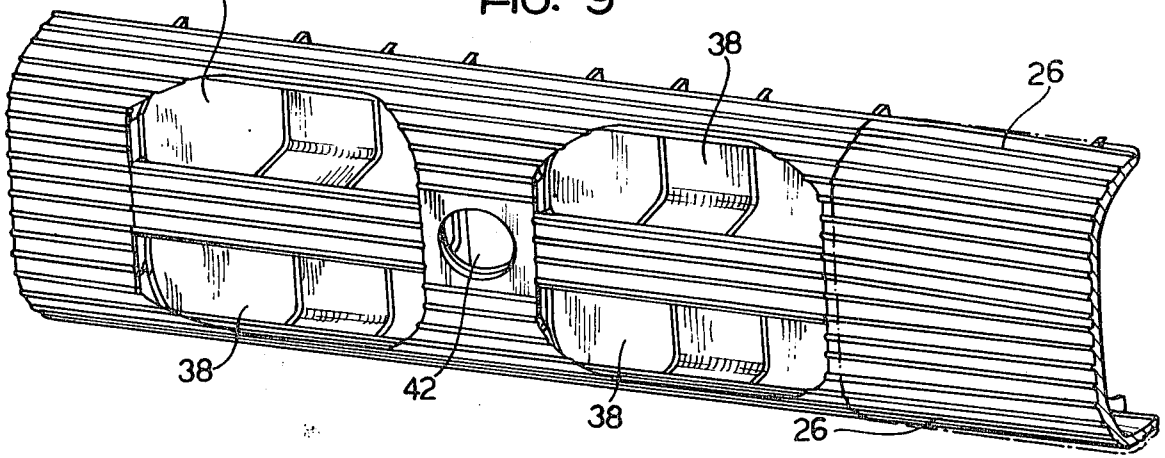
FIG. 9 is a perspective view from below of the part of the base sub-assembly shown in FIG. 8.

The outer sheet metal covering 26 is longitudinally corrugated or ribbed for strengthening, and is covered on the inside with a layer of sound and heat insulating material. In correspondence with the bogies 14, the base sub-assembly 16 is recessed to form wheel arches 38 as is shown in detail in FIGS. 8 and 9. In the region of these arches 38, the frame elements 22 have a simplified structure 40 (see FIG. 8). Between the two pairs of arches 38 associated with each bogie 14, the base sub-assembly 16 is formed with a circular opening 42 which serves to house a circular plate mounting the vertical pivot pin of the bogie 14.

The sheet-metal covering 26 of the base sub-assembly 16 is also provided with a series of hinged side doors 44 which open outwards away from the body 12 in order to allow access to the area between the said covering 26 and the flooring 28. This area is intended to house pneumatic and electrical equipment of the railway carriage 10.

Each of the side-and-roof sub-assemblies 18 consist of a series of vertically-extending lateral frame elements 46, 48 each of which is connected at its upper end with a respective sheet-metal frame part 50, 52. The frame parts 50 of one of the side-and-roof sub-assemblies 18 are connected to corresponding ones of the frame parts 52 of the other sub-assembly 18, each pairing of frame parts 50, 52 constituting an upper transverse frame element 54. The frame elements 46, 48 and 54 of the two sub-assemblies 18 are interconnected by channel-shaped girders 24 similar to those of the sub-assembly 16. The girders 24 are spot welded in position in square notches 56 formed in the flanged outer edges of the said elements 46, 48, 54. The structure of each sub-assembly 18 is completed by a respective outer covering of sheet-metal 58,60 spot welded to the girders 24 and to the frame elements 46, 48 and 54. The roof portions of the outer coverings 58 and 60 are longitudinally corrugated for strength and transversely terminate short of the laterally inner ends of the frame parts 50, 62. The gap between the facing longitudinal edges of the coverings 58 and 60, is spanned by a longitudinal strip 62 of corrugated or ribbed sheet-metal which is fixed to the upper horizontal girders 24 and inter-connects the coverings 58 and 60. A longitudinal glass ceiling bowl 63 is positioned below the sheet-metal strip 62 and is affixed to the upper frame elements 54. The portions of the coverings 58 and 60 corresponding to the sides of the railway carriage are provided with window and door apertures surrounded by strengthening frames 64. The coverings 58 and 60 are moreover coated on the inside with a layer of sound and heat insulating material covered with inner panels 66.

The laterally-inner end portions of the two frame parts 50, 52 making up each upper frame element 54 are so fashioned as to fit together to form a telescoped coupling between the parts which allows them to be longitudinally slid relative to each other during assembly of the body 12 and prior to the welding together of the parts 50 and 52; as a result, the length of each upper frame element 54 transversely of the body 12 can be adjusted during assembly to give a desired body width.

As shown in FIG. 6, the inner end portions of the two upper frame parts 50,52, shown at 112,114, respectively, are substantially Z-shaped like lugs 100,104, with respective upper and lower horizontally-extending flanges **112*a*,112*b* and 114*a*,114*b*. The upper flange 112*a* is depressed at 116 with respect to the upper flange 114*a*, while the lower flange 114*b* is raised at 118 with respect to the lower flange 112*b***.

In the assembled condition of the two upper frame parts 50, 52, shown in FIG. 7, the end portions 112,114 are telescoped one within the other, and the upper flanges **150*a*,152*a* of the frame parts 50,52, respectively, extend at the same level, as do the lower flanges 150*b*,152*b*** thereof.

The frame parts 50 and 52 are provided with circular outer lateral openings **50*a*, 52*a*, for the passage of electrical wiring, and with elongate inner lateral openings 50*b*,52*b* for the passage of longitudinal ducts 68 for conveying heating and ventilation air in the body 12. Each of these longitudinal ducts 68 is connected to a series of vertical conduits 70 which open out near to the flooring 36 of the base sub-assembly 16. The walls of the conduits 70 are integral with the panels 66 and serve to strengthen the panels 66 in the zones between the window openings. The outlet openings of the conduits 70 are covered by grids 72 mounted on longitudinal facing strips fixed to the inside of the body 12**.

As previously stated, the structural sub-assemblies 16 and 18 are separately prefabricated and subsequently joined by welding together the corresponding frame parts 50, 52 and rivetting the lower end portions of the frame elements 46 and 48 to the facing end portions of the frame elements 22. The resulting shell structure has the form of a sheet-metal skin attached to a plurality of square frames 76 with rounded corners (each frame 76 being constituted by a lower frame element 22, two lateral frame elements 46 and 48, and an upper frame element 54).

The structure of the body 12 is completed by the two end-wall units 20, shown diagrammatically in FIGS. 1 and 2. These units 20 may be of sheet-metal or of reinforced plastics material. In the former case, the units 20 are provided with small stiffener cross-bars, not illustrated, connected by welding to the girders 24 of the sub-assemblies 16 and 18. Where the units 20 are of reinforced plastics material, each unit can be formed with a unitary compartment **20*a* constituting a toilet in the railway carriage, the unit 20 being connected to the sub-assemblies 16 and 18 by bolting to the end frame 76. Regardless of its form, each unit 20 has a strength in the longitudinal direction of the body 12 which is less than the center part of the body 12. As a result, in the event of an accident, the units 20 will be the first components of the body 12** to suffer plastic deformation and will therefore serve to absorb impact energy and safeguard the passenger compartment.

When the joining together of the structural sub-assemblies 16, 18 and 20 is complete, the body 12 is finished off by the addition of the following items:

the buffer units and, where applicable, the traction units, the pneumatic systems of the carriage (general brake piping and compressed air piping for auxiliary controls), the electrical system (battery container, battery charger, transformer and electrical wiring), luggage compartments, passenger seats, tanks for sewage and for water, doors for closing in switchboard panels, air conditioning equipment including electrical heating resistances and ventilators, and the window and door units.

As can be seen in FIGS. 1 and 3, the carriage door units 78 (which are four in number) are located close to the ends of the body 12 and each comprise two doors 78*a* hinged along opposite vertical edges to swing open away from the center of the unit 78, and a lower footboard 78*b* hinged about a horizontal axis. This footboard 78*b* incorporates a number of steps and can be swung down to allow passengers to enter and leave the carriage with ease.

From the foregoing, it will be apparent that the structural form of the described carriage body is very simple which not only allows the body to be manufactured on a production line, but also enables the weight of the body to be substantially reduced as compared with known carriage bodies. This latter factor, in addition to allowing a reduction in the initial cost of manufacture, also enables considerable reductions in operating costs to be achieved while at the same time providing for increased carrying capacity.

I claim:

1. A railway carriage body comprising a shell structure formed from the following structural sub-assemblies;

a base sub-assembly comprising a series of transverse lower frame elements spaced longitudinally of said body and each constituted by a respective pair of sheet-metal frame parts welded together, girders interconnecting the said lower frame elements, an outer sheet-metal covering fixed to said girders and to the lateral and lower edges of the said lower frame elements, and a flooring fixed to the upper edges of the said lower frame elements, a pair of side-and-roof sub-assemblies each forming one side and part of the roof of the said body and comprising a series of vertically-extending lateral frame elements connected at their lower ends to the said lower frame elements, and a series of upper transverse frame parts connected to the upper ends of respective ones of said vertical frame elements, corresponding said frame parts of the two side-and-roof sub-assemblies being welded together in the assembled body to form a series of upper transverse frame elements together with the said lateral and lower frame elements form a series of frames of rectangular shape, each side-and-roof subassembly further comprising a plurality of girders extending longitudinally of said body and serving to interconnect the said frame elements of the sub-assembly, and an outer sheet-metal covering affixed to said frame elements and girders and provided with strengthening frames defining window and door openings, a pair of end-wall units affixed to opposite ends of the said sub-assemblies, the said frame parts making up each upper and each lower frame element having their inner end portions, considered laterally of the body, telescoped one within the other to permit adjustment of the width of said carriage body during assembly prior to being permanently joined together, and means for permanently joining together the said frame parts making up each upper and each lower frame element.

* * * * *